US008176970B2

(12) United States Patent
Ito et al.

(10) Patent No.: US 8,176,970 B2
(45) Date of Patent: May 15, 2012

(54) TWIN-BELT CASTING MACHINE AND METHOD OF CONTINUOUS SLAB CASTING

(75) Inventors: Toshiaki Ito, Shizuoka (JP); Noboru Kubota, Shizuoka (JP); Kazumi Touno, Shizuoka (JP)

(73) Assignee: Nippon Light Metal Company, Ltd., Shinagawa-ku, Tokyo (JP)

( * ) Notice: Subject to any disclaimer, the term of this patent is extended or adjusted under 35 U.S.C. 154(b) by 0 days.

(21) Appl. No.: 12/745,399

(22) PCT Filed: Nov. 5, 2008

(86) PCT No.: PCT/JP2008/070075

§ 371 (c)(1),
(2), (4) Date: May 28, 2010

(87) PCT Pub. No.: WO2009/069437

PCT Pub. Date: Jun. 4, 2009

(65) Prior Publication Data

US 2010/0307713 A1 Dec. 9, 2010

(30) Foreign Application Priority Data

Nov. 29, 2007 (JP) ..... 2007-308228

(51) Int. Cl.
*B22D 11/06* (2006.01)

(52) U.S. Cl. ..... 164/431; 164/432; 164/443

(58) Field of Classification Search ..... 164/431, 164/432, 443

See application file for complete search history.

(56) References Cited

U.S. PATENT DOCUMENTS

| | | | | |
|---|---|---|---|---|
| 2,640,235 | A * | 6/1953 | Hazelett | 164/481 |
| 4,674,558 | A | 6/1987 | Hazelett et al. | |
| 2007/0215314 | A1 | 9/2007 | Fitzsimon et al. | |

FOREIGN PATENT DOCUMENTS

| | | |
|---|---|---|
| JP | 58-154443 | 9/1983 |
| JP | 60-130454 | 7/1985 |
| JP | 1-122638 | 5/1989 |
| JP | 2004-156117 A | 6/2004 |
| WO | WO 02/11922 | 2/2002 |
| WO | WO 2007/104156 | 9/2007 |

OTHER PUBLICATIONS

Canadian Office Action for corresponding Canadian Patent Application No. 2,707,123 mailed Sep. 16, 2011.

* cited by examiner

*Primary Examiner* — Jessica L Ward
*Assistant Examiner* — Erin Saad
(74) *Attorney, Agent, or Firm* — Merchant & Gould P.C.

(57) ABSTRACT

There is provided a twin-belt casting machine which prevents an uneven cooling condition between the top surface and the bottom surface of a slab between a pair of endless belts disposed vertically. The twin-belt casting machine 1 comprises a pair of rotating belt units 3 including respective endless belts 2 and arranged up and down so as to face each other, a cavity 4 formed between the pair of rotating belt units 3, and cooling means 10 which is arranged inside the rotating belt unit 3. The twin-belt casting machine 1 continuously casts a slab S as a metal liquid is supplied in the cavity 4. The twin-belt casting machine 1 further comprises distance adjusting means which is arranged inside at least one of the pair of rotating belt units arranged up and down so as to face each other, and which moves apart or closer the endless belt relative to the slab S in accordance with a part where the slab and the endless belt become distant from each other.

9 Claims, 14 Drawing Sheets

TWIN-BELT CASTING MACHINE AND METHOD OF CONTINUOUS SLAB CASTING

This application is a National Stage Application of PCT/JP2008/070075, filed 5 Nov. 2008, which claims benefit of Ser. No. 2007-308228, filed 29 Nov. 2007 in Japan and which applications are incorporated herein by reference. To the extent appropriate, a claim of priority is made to each of the above disclosed applications.

TECHNICAL FIELD

The present invention relates to a twin-belt casting machine which continuously casts slabs, and a method of continuous slab casting.

BACKGROUND ART

Conventionally known twin-belt casting machines produce a continuously cast slab product (hereinafter called slab), which is made of aluminum or an aluminum alloy. FIG. 17 is a diagram showing a conventional twin-belt casting machine, where (a) is a side view and (b) is an enlarged view showing a downstream side of a cavity.

As shown in FIG. 17, a conventional twin-belt casting machine 1 pours such a molten metal as a molten aluminum-alloy through between a pair of rotating belt units 3, 3 which are disposed opposite each other in the vertical direction, and casts a slab S continuously (see, for example, documents 1 and 2).

More specifically, the twin-belt casting machine 1 includes the pair of rotating belt units 3, 3 each having an endless belt and facing opposed in the vertical direction; a cavity 4 formed between the pair of rotating belt units 3, 3; and a cooling means (not shown in the accompanying drawings) provided in each rotating belt unit 3. A bottom endless belt 2*a* of the bottom rotating belt unit 3 comprises thin metal plates, and is wound around a drive roller 5*a* and a support roller 6*a* which are spaced apart from each other. A top endless belt 2*b* of the top rotating belt unit 3 also comprises thin metal plates, and wound around a drive roller 5*b* and a support roller 6*b* which are spaced apart from each other. The slab S is continuously pushed out to the downstream side in the casting direction when the drive roller 5*a* is rotated in the clockwise direction and the drive roller 5*b* is rotated in a counter-clockwise direction.

The cooling means, not shown in the accompanying drawings, has a nozzle or the like for spraying coolant water, and supplies the coolant water or the like to the back surface of the endless belt 2, thereby cooling the slab S formed in the cavity 4.

A molten metal is supplied from an injector 7 or the like provided at an upstream side, and it moves at a substantially same speed as that of the endless belts 2 which move in the cavity 4, is cooled and solidified while releasing heat to the endless belt 2, held between pinch rollers 8 or the like from the downstream side, and pulled out as the slab S. Note that a body which is not completely solidified among slabs S is hereinafter called an ingot S in some cases.

Document 1: JP2004-505774A

Document 2: International Publication No. 2007/104156 brochure

DISCLOSURE OF INVENTION

Technical Problem

The conventional twin-belt casting machine 1 sometimes undergoes a problematic phenomenon in which the surface of a slab S pulled out from the twin-belt casting machine 1 is corrugated in the casting direction if a so-called strain occurs in the casted slab.

One reason for such corrugation may be uneven cooling condition between the top surface and the bottom surface of the slab between the pair of bottom endless belt 2*a* and top endless belt 2*b* facing opposed in the vertical direction. That is, as shown in FIG. 17(*b*), the top surface of the ingot S contacts the top endless belt 2*b* and the bottom surface of the ingot S contacts the bottom endless belt 2*a* at the upstream side of the cavity 4. The thickness of the slab decreases because the slab solidifies and contracts more as it is fed to the downstream side farther. As shown in FIG. 17(*b*), the top surface of the ingot S becomes separated from the top endless belt 2*b* by a distance Kb at the downstream side of the cavity 4. Accordingly, imbalance occurs between a distance between the bottom surface of the ingot S and the bottom endless belt 2*a* and a distance between the top surface of the ingot S and the top endless belt 2*b*, and this results in uneven cooling condition between the top surface and the bottom surface of the slab.

Since uneven cooling condition between the top surface and the bottom surface of the ingot S causes corrugation on the surface of the slab S, this corrugation causes vibration. If such vibration is transferred to a meniscus unit, the casted slab S has a problem of surface defect. Moreover, the uneven cooling condition between the top surface and the bottom surface of the ingot S is still problematic because the profile of the slab S may be worsened if a temperature distribution may be uneven noticeably in the width direction of the slab S. Furthermore, the uneven cooling condition between the top surface and the bottom surface of the ingot S is still problematic because a temperature distribution in the casting direction periodically changes, and it becomes difficult to control synchronization with a skin-pass rolling mill, a take-up machine, or the like provided at the downstream side of the twin-belt casting machine 1.

The present invention was conceived in consideration of the foregoing problems, and it is an object of the present invention to provide a twin-belt casting machine which can prevent uneven cooling condition between the top surface and the bottom surface of a slab by using a pair of endless belts arranged opposed vertically. Moreover, it is another object of the present invention to provide a method of continuous slab casting which can prevent uneven cooling condition between the top surface and the bottom surface of a slab by using a pair of endless belts arranged opposed vertically.

Technical Solution

In order to overcome the foregoing problems, a twin-belt casting machine for casting continuously a slab from a molten metal comprises: a pair of rotating belt units arranged vertically and disposed opposite each other, each rotating belt unit including an endless belt; a cavity formed between the pair of rotating belt units, the cavity into which the molten metal is supplied; cooling means which is arranged inside each rotating belt unit; and distance adjusting means, disposed inside at least one of the pair of rotating belt units, for lifting up and down the endless belt relative to the slab in accordance with a part where the slab and the endless belt become separated from each other.

According to such a configuration, even if the slab solidifies and contracts and the strip thickness becomes thin, a distance between the bottom endless belt and the bottom surface of the slab and a distance between the top endless belt and the top surface of the slab can be adjusted, thereby preventing uneven cooling condition between the top surface and the bottom surface of a slab.

It is preferable that the cooling means is disposed in a casing and includes a plurality of nozzles each supporting the endless belt from inside the each nozzle including a support part, the distance adjusting means includes a lift means which lifts up and down the nozzles; and a through hole opening toward the endless belt and allowing a coolant medium to flow therethrough to support the endless belt.

According to such a configuration, the cooling medium flows out from the nozzle cools the endless belt, and the endless belt supported by the support part of the nozzle can be lifted up and down by the lift means, thereby enabling adjustment of a distance between the slab and the endless belt.

It is preferable that the lift means includes: a cylinder provided at one end of the nozzle; a piston sliding inside the cylinder; and a piston rod connecting the piston and the nozzle, and wherein the nozzle is lifted up and down by means of pressure. According to such a configuration, the lift means can be configured with a relatively simple configuration.

It is preferable that the piston rod has a hollow part formed in the piston rod, and the hollow part supplies the cooling medium to the nozzle. According to such a configuration, as the cooling medium is supplied via the piston rod, it is possible to configure the cooling means with the number of parts being reduced.

It is preferable that the lift means includes: a connecting bar attached to the plurality of nozzles; a cylinder provided in a vicinity of the connecting bar; a piston sliding inside the cylinder; and a piston rod connecting the piston and the connecting bar together, and wherein the nozzle is lifted up and down by means of pressure.

According to such a configuration, because the connecting bar which connects the plurality of nozzles together is provided, it becomes possible to lift up and down the plurality of nozzles together and to adjust a distance between the endless belt and the slab. This makes it possible to adjust the distance highly precisely with a simple configuration.

It is preferable that the lift means includes: an elastic member which is disposed inside the nozzle and urges the nozzle toward the endless belt side; a slide bar disposed in the vicinity of the plurality of nozzles; and an engagement part formed on each nozzle, and wherein, when the slide bar slides and moves in a lateral direction relative to the nozzle, projection parts protruding from the slide bar and arranged in a lengthwise direction of the slide bar at a predetermined interval engage with the engagement parts corresponding to respective projection parts, thereby lifting down the nozzle.

According to such a configuration, as the slide bar is slid and moved, the plurality of nozzles are lifted up and down together to adjust the distance between the slab and the endless belt. This makes it possible to adjust the distance highly precisely with a simple configuration.

It is preferable that the slide bar is slid and moved by a feed screw. According to such a configuration, it is possible to cause the slide bar to slide and move with a simple configuration.

It is preferable that an insertion hole into which the slide bar is inserted is formed in an external wall of the casing, and an O-ring is provided at a clearance formed between the insertion hole and the slide bar. According to such a configuration, the interior of the casing can be sealed reliably.

It is preferable that the distance adjusting means moves the endless belt toward, or separate from, the slab by means of an electromagnetic force. According to such a configuration, it is possible to adjust the distance between the slab and the endless belt with a relatively simple configuration.

It is preferable that the distance adjusting means moves a part of the endless belt toward, or separate from, the slab in a width direction of the slab. According to such a configuration, in the width direction of the slab, even if the distance between the bottom endless belt and the bottom surface of the slab and the distance between the top endless belt and the top surface of the slab are unbalanced, each distance can be adjusted, thereby preventing uneven cooling condition between the top surface and the bottom surface of a slab.

The present invention also provides a method of continuous slab casting which continuously casts a molten metal, supplied to a cavity formed between a pair of endless belts disposed vertically and opposed, into slabs, wherein at least one of the pair of endless belts is moved toward, or separate from, the slab in accordance with a part where the slab and the endless belt become separated from each other.

According to such a configuration, even if the slab solidifies and contracts and the strip thickness becomes thin, the distance between the bottom endless belt and the bottom surface of the slab and the distance between the top endless belt and the top surface of the slab can be adjusted, thereby preventing uneven cooling condition between the top surface and the bottom surface of a slab.

According to the present invention, it is preferable that the slab is cast while an effective cavity length is adjusted during casting. According to such a configuration, it is possible to produce a slab with desired characteristics by appropriately adjusting the range of cooling the slab.

Advantageous Effects

According to the twin-belt casting machine of the present invention, since uneven cooling condition between the top surface and the bottom surface of a slab between a pair of endless belts arranged up and down is prevented, it is possible to suppress any distortion of a slab. Moreover, according to the continuous slab casting method of the present invention, as uneven cooling condition between the top surface and the bottom surface of a slab between a pair of endless belts arranged up and down is prevented, it is possible to produce a slab with little distortion.

EXPLANATION OF REFERENCE

Figure 1:
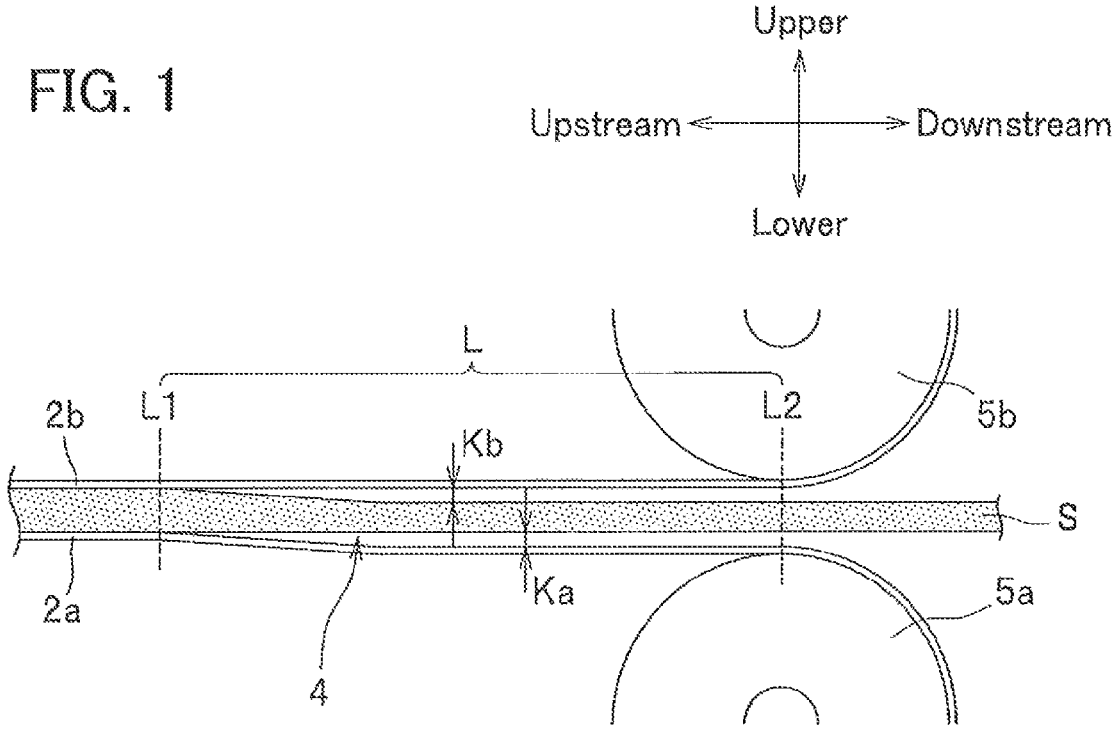
FIG. 1 is an enlarged view of a downstream side of a cavity used in a method of continuous slab casting according to a first embodiment.

1 Twin-belt casting machine
2 Endless belt
2*a* Bottom endless belt
2*b* Top endless belt
3 Rotating belt unit
4 Cavity
5*a* Drive roller
5*b* Drive roller
6*a* Support roller
6*b* Support roller
7 Injector
10 Cooling means
11 Lift means (distance adjusting means)
12 Water supply nozzle
13 Cooling tank
14 Water supply pipe
14*b* Water supply pipe
21 Through hole
24 Engagement part
31 Elastic member
32 Slide bar
32*b* Convex part
62 Cylinder
63 Piston
63*a* Hollow part
64 Piston rod
81 O-ring
82 Feed screw
90 Electromagnet (distance adjusting means)
L Separated part
S Slab (ingot)
Q Casing

BEST MODE FOR CARRYING OUT THE INVENTION

Figure 17A:
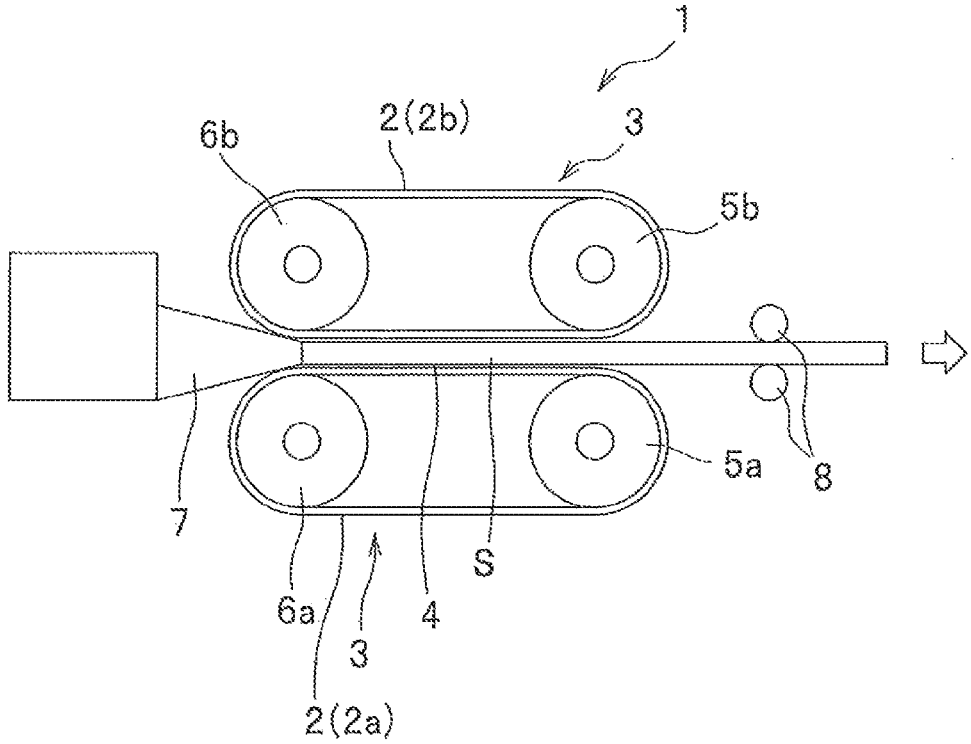
FIG. 17 is a diagram showing a conventional twin-belt casting machine, where (a) is a side view and (b) is an enlarged view showing a downstream side of a cavity.
Figure 17B:
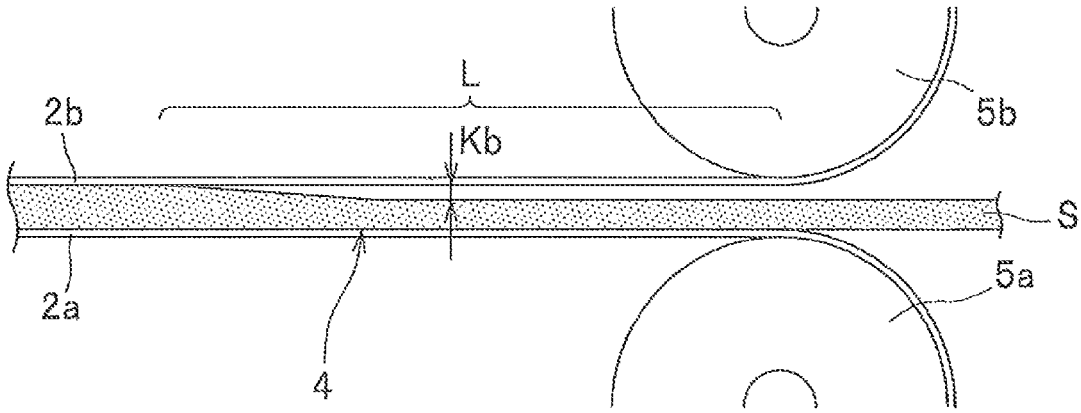

In the following embodiments of the present invention, a method of continuous slab casting will be explained first, and then a structure of a twin-belt casting machine will be explained in detail. In general, a twin-belt casting machine used for the continuous slab casting method has the same structure as that of the twin-belt casting machine 1 shown in FIG. 17, so the duplicate explanation thereof will be omitted. Note that accompanying drawings have scale sizes changed appropriately in the vertical direction or in the horizontal direction in order to facilitate understanding of the explanation.

<First Embodiment>

As shown in FIG. 1, the method of continuous slab casting according to the first embodiment is characterized in that a part of a bottom endless belt 2*a* is moved downward (i.e. to the inward direction of the bottom endless belt 2*a*). FIG. 1 is an enlarged view showing a downstream side of a cavity and showing the method of continuous slab casting of the first embodiment. Through the accompanying drawings, directions defined as "Upper" and "Lower" shown in FIG. 1 specify vertical directions with respect to the casted slab, and directions defined as "Upstream" and "Downstream" specify casting directions.

As shown in FIG. 1, according to the method of continuous slab casting of the first embodiment, the bottom endless belt 2*a* is lowered and disposed lower than the height position where an ingot S is in contact with the bottom endless belt 2*a* on the upstream side within a part L where the top surface of the ingot S becomes separated from an top endless belt 2*b*. The method according to the present embodiment can prevent uneven cooling condition between the top surface and the bottom surface of a slab by moving the bottom endless belt 2*a*.

Preferably, in the present embodiment, a distance Kb between the top surface of the ingot S and the top endless belt 2*b* should be substantially equal to a distance Ka between the bottom surface of the ingot S and the bottom endless belt 2*a*. Since the distance Ka and the distance Kb are substantially equal, the slab can be cooled uniformly between the top surface of the ingot S and the bottom surface thereof.

The part L (hereinafter alternatively called a separated part L) where the top surface of the ingot S becomes separated from the top endless belt 2*b* covers a range from a start position L1 where the thickness of the slab starts reducing due to solidification and shrinkage of the ingot S to an end L2 of a cavity 4. It is preferable that the bottom endless belt 2*a* should be lowered within the hole length of the separated part L. Alternatively, the bottom endless belt 2*a* may be lowered within a part of the separated part L. Note that a structure of a distance adjusting means which lowers the bottom endless belt 2*a* will be discussed later.

<Second Embodiment>

Figure 2A:
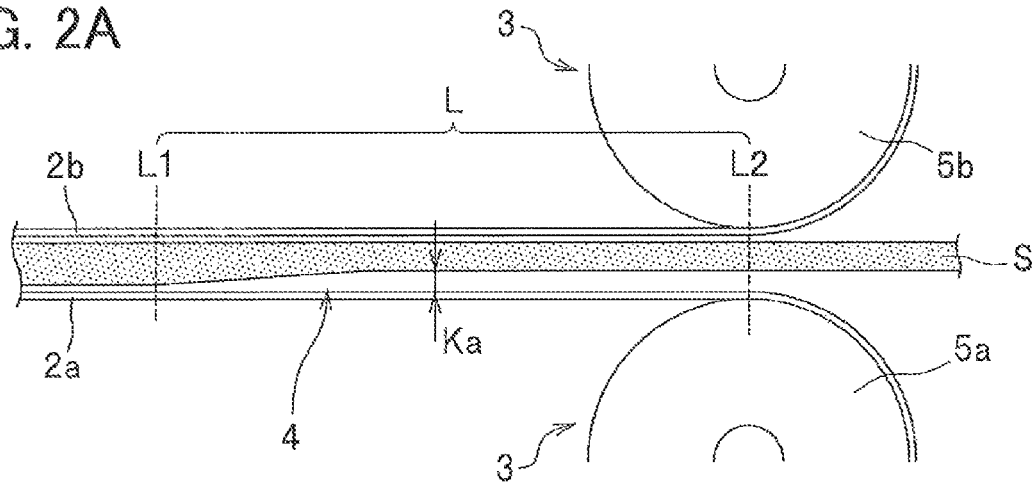
FIG. 2 is an enlarged view of a downstream side of a cavity used in the method of continuous slab casting according to a second embodiment, where (a) shows a normal condition and (b) shows a lifted condition.
Figure 2B:
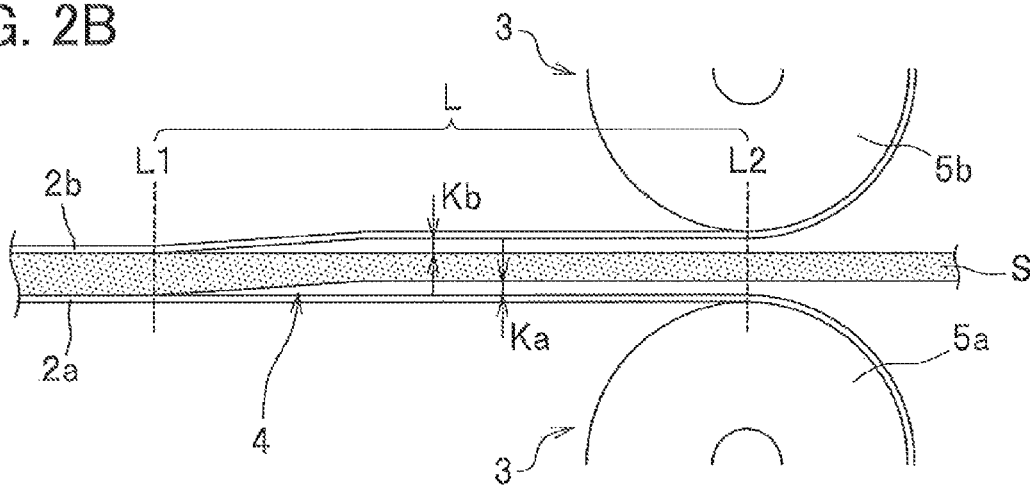

A method of continuous slab casting of the second embodiment is different from the first embodiment because, as shown in FIG. 2, a part of the top endless belt 2*b* is moved upwardly (to the inward direction of the top endless belt 2*b*). FIG. 2 is an enlarged view showing the downstream side of the cavity and showing the method of continuous slab casting according to the second embodiment, where (a) shows a normal condition and (b) shows a lifted condition.

For example, in some cases as shown in FIG. 2(*a*), the thickness of the slab may decrease, and the bottom surface of the ingot S may be separated from the bottom endless belt 2*a* when the ingot S solidifies and contracts if the temperature of a coolant medium ejected from the cooling means, not shown in the accompanying drawings and arranged in the top rotating belt unit 3, is set to be lower than the temperature of coolant medium ejected from the cooling means, not shown in the accompanying drawings and arranged in the bottom rotating belt unit 3bottom endless belt.

In order to address such a case as shown in FIG. 2(*b*), in the method of continuous slab casting according to the present invention, the top endless belt 2*b* is relatively lifted higher than the position where the ingot S is in contact with the top endless belt 2*b* at the upstream side within a separated part L where the bottom surface of the ingot S is separated from the bottom endless belt 2*a*. This prevents uneven cooling condition between the top surface and the bottom surface of the slab.

It is preferable that a distance Ka from the bottom surface of the ingot S to the bottom endless belt 2*a* should be substantially equal to a distance Kb from the top surface of the ingot S to the top endless belt 2*b*. Because the distance Ka and the distance Kb become substantially equal, the cooling condition for the slab becomes uniform between the top surface of the ingot S and the bottom surface thereof.

Although the endless belt is lifted up or down from the ingot S in the first and second embodiments, the present invention is not limited to this configuration. The endless belt 2 may be moved closer to the ingot S by using distance adjusting means, which will be discussed later, to make the distance balanced.

<Third Embodiment>

Figure 3:
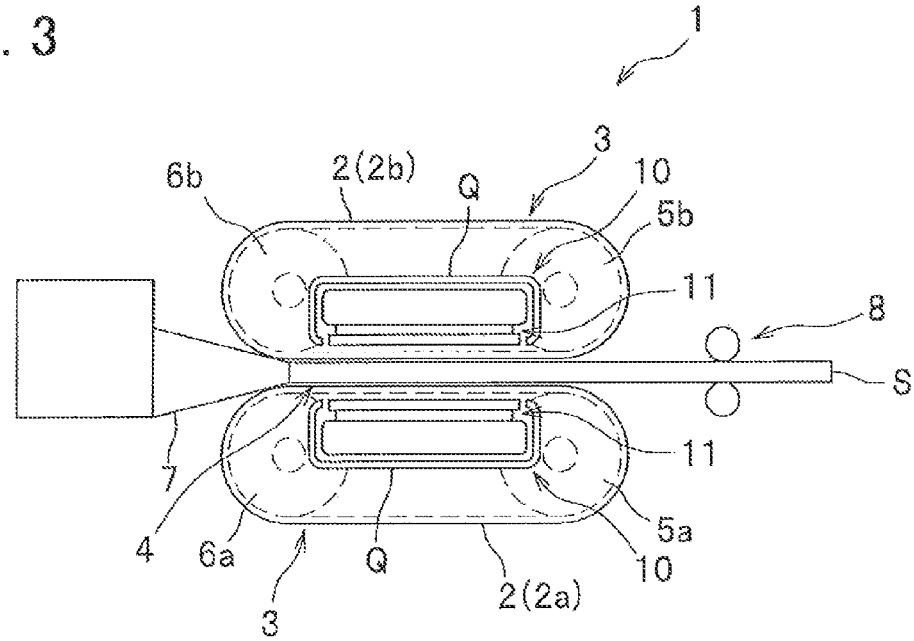
FIG. 3 is a side view showing a twin-belt casting machine according to a third embodiment.
Figure 4:
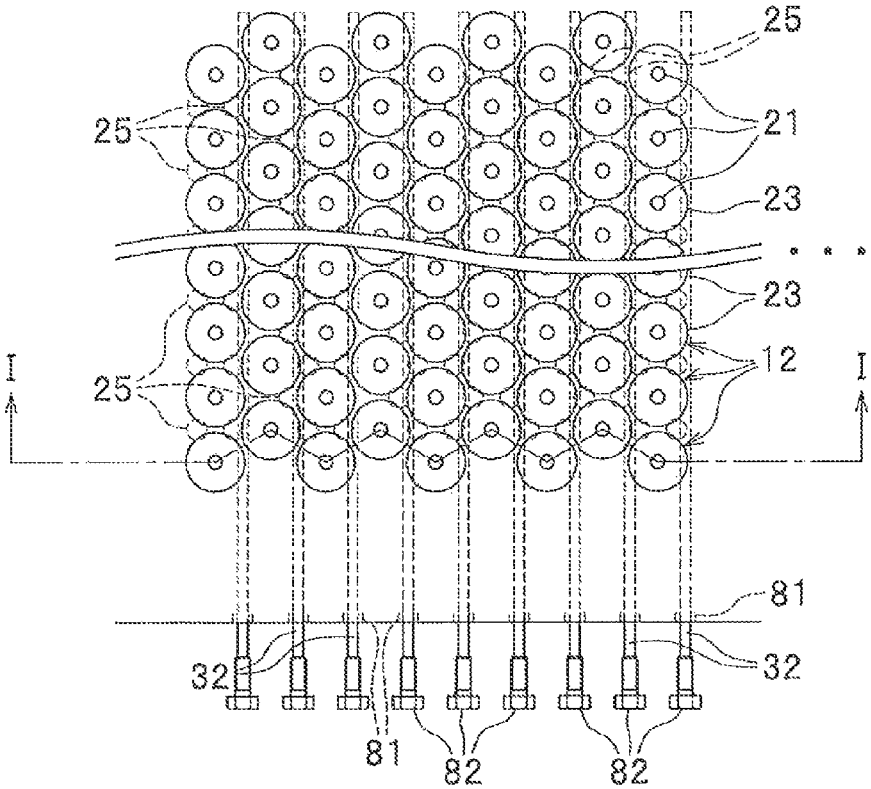
FIG. 4 is a plan view showing cooling means according to the third embodiment.
Figure 5:
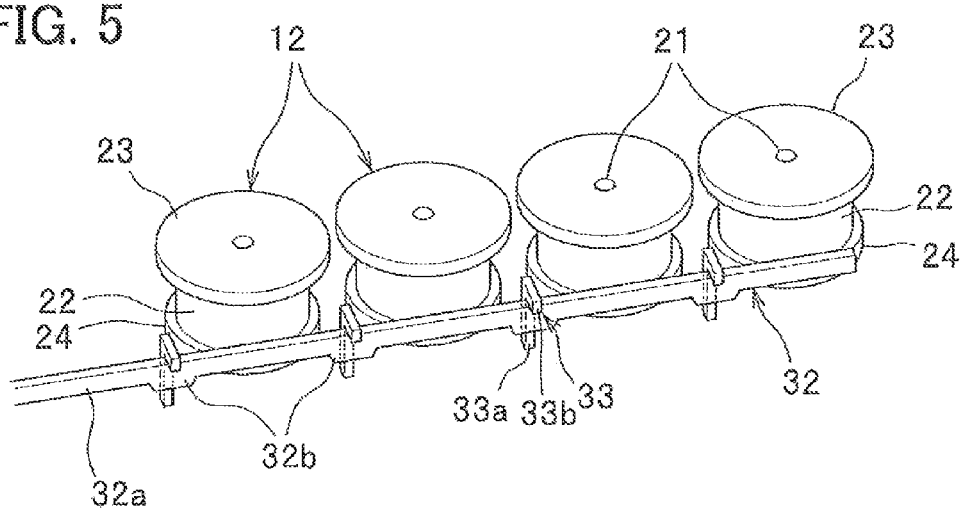
FIG. 5 is a perspective view showing a water supply nozzle according to the third embodiment.
Figure 6A:
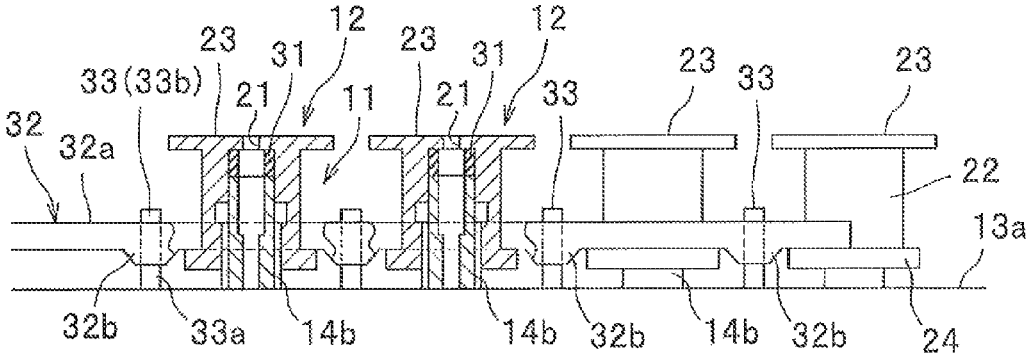
FIG. 6 is a diagram showing lift means according to the third embodiment, where (a) shows a lifted-up condition and (b) is a lifted-down condition.
Figure 6B:
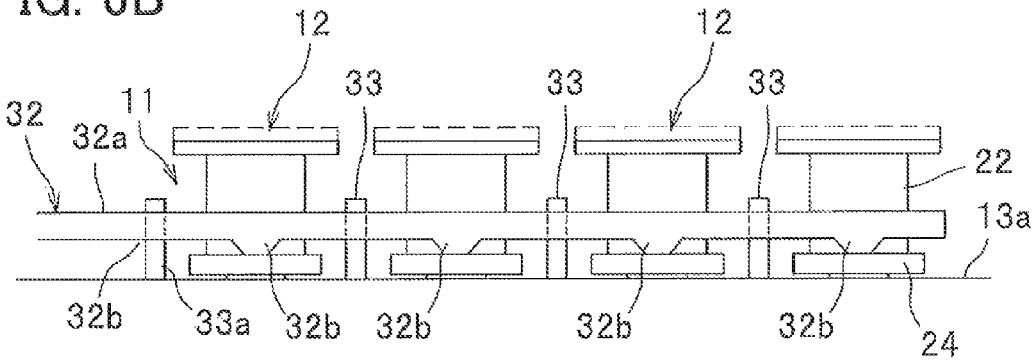
Figure 7:
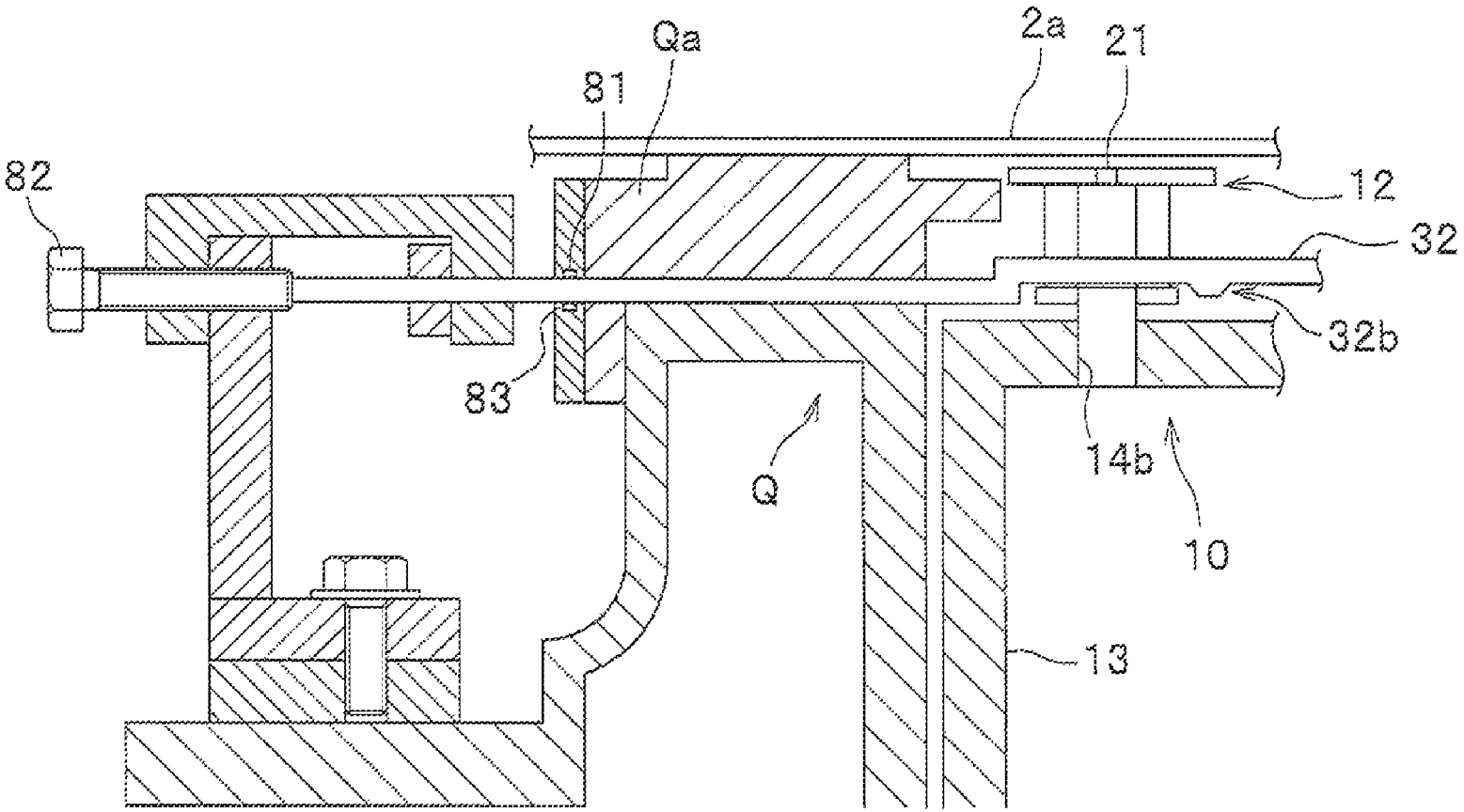
FIG. 7 is a front view showing an end of a slide bar according to the third embodiment.
Figure 8:
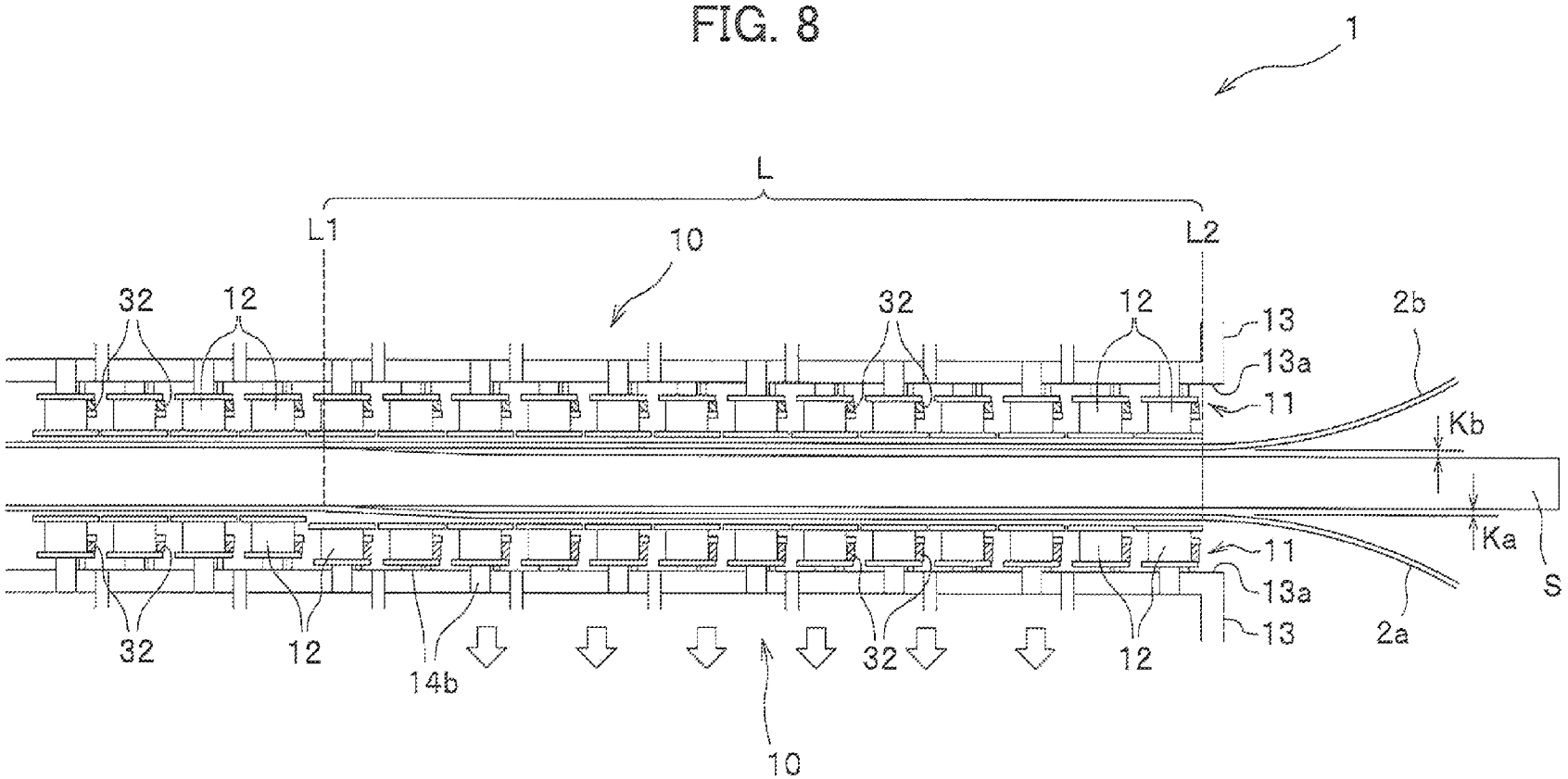
FIG. 8 is a side view showing endless belts spaced apart from each other at a downstream side of a cavity according to the third embodiment (viewed along a line I-I shown in FIG. 4)

Hereafter, a configuration of a twin-belt casting machine 1 according to a third embodiment of the present invention will be explained in detail. FIG. 3 is a side view showing a twin-belt casting machine according to the third embodiment. FIG. 4 is a plan view showing cooling means according to the third embodiment. FIG. 5 is a perspective view showing a water supply nozzle according to the third embodiment. FIG. 6 is a diagram showing lift means according to the third embodiment, where (a) shows a lifted-up condition and (b) shows a lifted-down condition. FIG. 7 is a front view showing an end of a slide bar according to the third embodiment. FIG. 8 is a side view showing endless belts separated from each other at a downstream side of a cavity according to the third embodiment.

As shown in FIG. 3, the twin-belt casting machine 1 of the present embodiment has an injector 7 a pair of pinch rollers 8. The injector 7 is arranged on the upstream side and supplies a molten metal liquid to the twin-belt casting machine 1. The pinch rollers 8 are arranged on the downstream side and hold the cast slab S therebetween at a predetermined position. That is, the twin-belt casting machine 1 cools down the liquid metal supplied from the injector 7, and forms the ingots S in the cavity 4, and then continuously produces the solidified slabs S as products to the downstream side.

More specifically, the twin-belt casting machine 1 comprises the pair of rotating belt units 3, 3; the cavity 4; the cooling means 10 and lift means 11. Each rotating belt unit 3 has an endless belt, and the rotating belts are opposed vertically. The cavity 4 is arranged between the pair of rotating belt units 3, 3. The cooling means 10 is provided inside each rotating belt unit 3. The lift means 11 adjusts the distances from each rotating belt to the slab.

The bottom endless belt 2*a* of the bottom rotating belt unit 3 comprises thin metal plates, and is wound around the drive roller 5*a* and a support roller 6*a* which are separated from each other.

Conversely, the top endless belt 2*b* of the top rotating belt unit 3 comprises thin metal plates, and is wound around a drive roller 5*b* and a support roller 6*b* which are separated from each other. If the drive roller 5*a* is rotated in the clockwise direction and the drive roller 5*b* is rotated in the counter-clockwise direction, the slabs S are pushed out to the downstream side of the casting direction continuously.

As shown in FIG. 3, the cooling means 10 and the lift means 11 are arranged inside (inner circumference side) of each of the pair of endless belts 2, and enclosed in a casing Q. Except for the arrangement, the cooling means 10 and the lift means 11 disposed at the top side are the same as the cooling means 10 and the lift means 11 disposed at the bottom side. In the following, only the cooling means 10 and the lift means 11 on the bottom side will be explained.

As shown in FIGS. 3 to 6, the cooling means 10 causes water as coolant medium to flow from the back surface of the bottom endless belt 2*a* and cools down the ingot S. In the present embodiment, the cooling means 10 mainly comprises a plurality of nozzles (water supply nozzles) 12; a coolant tank 13 (see FIG. 7); a pump not shown in the accompanying drawings; and water supply pipes 14*b*. The nozzles 12 discharge the coolant water. The coolant tank 13 retains the coolant water therein. The pump supplies the coolant water to the coolant tank 13. Each water supply pipe 14*b* is used for connecting the coolant tank 13 to the water supply nozzle 12.

The water supply nozzles 12, arranged behind the back side of the bottom endless belt 2*a* with slight clearances, discharge the coolant water to cool down the bottom endless belt 2*a*, and support the bottom endless belt 2*a*. As shown in FIG. 4, each water supply nozzle 12 has a circular shape in plan view, and the water supply nozzles 12 are arranged in a staggered arrangement.

As shown in FIGS. 5 and 6, each water supply nozzle 12 communicates with the coolant tank 13, and covers the top of the water supply pipe 14*b* protruding from a top base 13*a* of the coolant tank. The water supply nozzle 12 includes a main body 22, a support part 23 formed at the top part of the main body 22, and an engagement part 24 formed at the bottom part of the main body 22. The main body 22 of the water supply nozzle 12 is formed in a cylindrical shape. The main body 22 has its inner circumference contacting the top outer circumference of the water supply pipe 14*b*, and is slidable in the vertical direction relative to the water supply pipe 14*b*.

As shown in FIGS. 5 and 6, the support part 23 faces the back side of the bottom endless belt 2*a* and has a slight clearance therebetween. The bottom endless belt 2*a* is supported by the coolant water discharged from the support part 23. More specifically, the coolant water discharged through a through hole 21 formed at the center of the support part 23 toward the bottom endless belt 2*a*. The through hole 21communicates with the water supply pipe 14*b*.

The engagement part 24 engages with a slide bar 32, which will be explained later. The engagement part 24 is projected outward from the outer circumference of the main body 22, and has an annular shape in plan view in the present embodiment. The shape of the engagement part 24 is not limited to any particular one, and can be designed in any shape in accordance with the position of the slide bar 32 and the shape of a projection part 32*b* of the slide bar 32.

As shown in FIGS. 4 to 6, the top surfaces of the support parts 23 of the adjoining water supply nozzles 12 are flush with each other, and the adjoining support parts 23 are arranged in a staggered manner. There are slight clearances among the adjoining support parts 23. Moreover, as shown in FIG. 4, drain holes 25 are formed below where adjoining support parts 23 face each other. Each drain hole 25 is connected to a drain pipe, not shown in the accompanying drawings, passing all the way through the coolant tank. The drain pipe is connected to a pump, not shown in the accompanying drawings, provided below the coolant tank. The water collected from the drain holes 25 are reused as the coolant water.

That is, the coolant water supplied to the coolant tank by the pump flows from the through hole 21 toward the back side of the bottom endless belt 2*a* through the main body 22. The coolant water discharged from the through hole 21 cools down the bottom endless belt 2*a*, and flows into the drain pipe through the drain holes 25 formed among the adjoining water supply nozzles 12. The coolant water is introduced into the pump again.

Since the water supply nozzles 12 arranged in a staggered arrangement enable a proximate arrangement of the through holes 21, the coolant water can be discharged from the through holes 21 uniformly, and as a result, a uniform cooling condition can be achieved between the top surface and the bottom surface of the slab.

Figure 9:
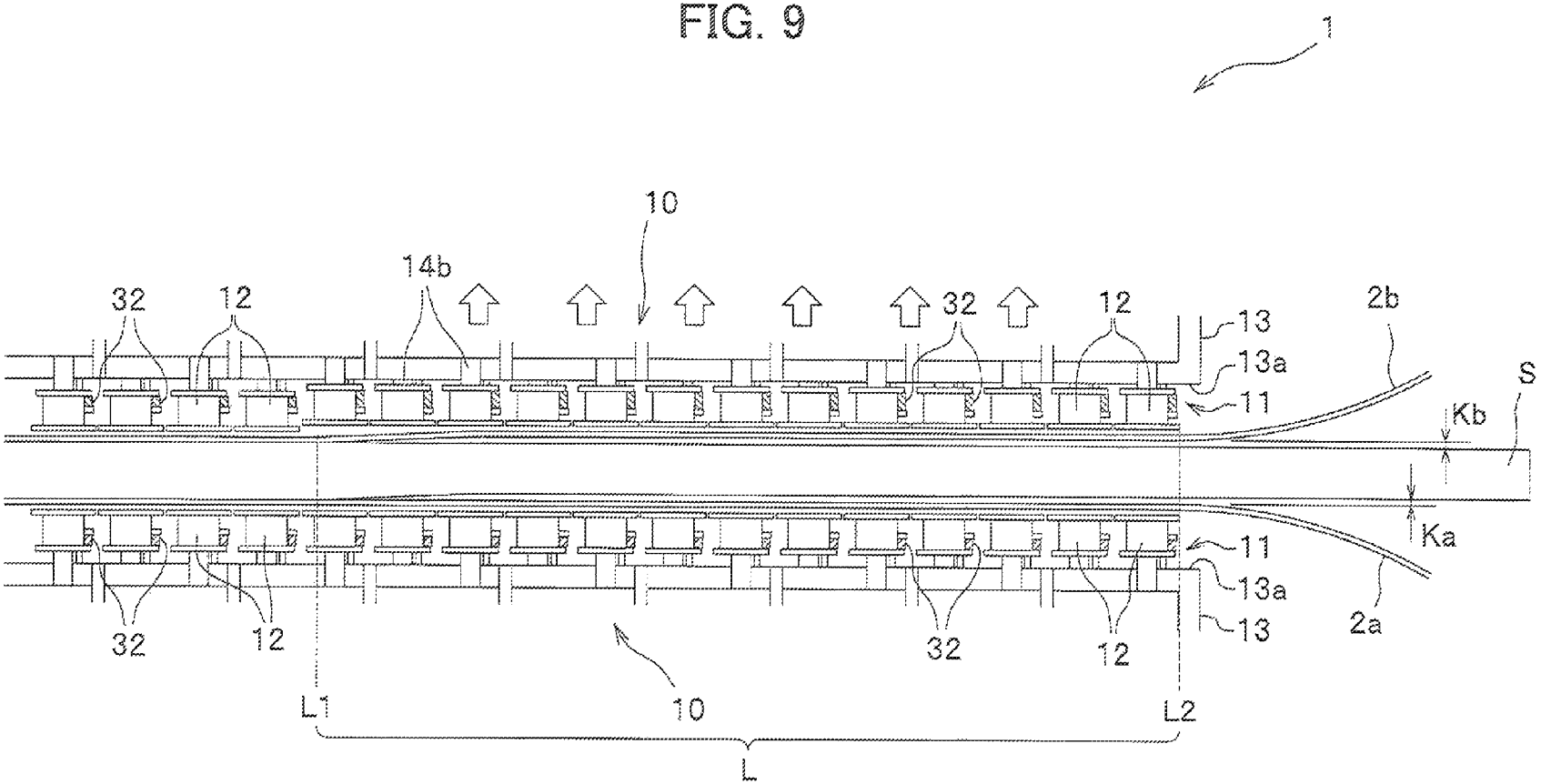
FIG. 9 is a side view showing endless belts spaced apart from each other at a downstream side of a cavity according to a fourth embodiment.

Here we assume that a line of the plurality of water supply nozzles 12 arranged in the width direction is called a "row". In the present embodiment, rows, each of which includes the plurality of water supply nozzles 12, are arranged offset in the width direction. For example, 17 rows are arranged as shown in FIGS. 8 and 9. Also, 9 rows are arranged as shown in FIG. 4. The number of rows, each including the plurality of water supply nozzles 12, can be set appropriately in accordance with the length of the cavity 4.

Moreover, a conventionally known temperature adjusting means which adjusts a temperature of the coolant water may be provided to the cooling pump or the coolant tank. This makes it possible to adjust the temperature of the coolant water and to change the cooling speed as needed.

The lift means 11 lifts up or down the water supply nozzles 12. In the present embodiment, as shown in FIG. 6(*a*), the lift means 11 includes an elastic member 13 provided in the water supply nozzle 12; the slide bar 32 arranged for each row of the water supply nozzles 12; and tabs 33 which prevent the slide bar 32 from being lifted up.

The elastic member 31 arranged inside the water supply nozzle 12urges the water supply nozzle 12 upwardly (toward the slab) relative to the water supply pipe 14*b*. In the present embodiment, the elastic member 31 is a rubber-made ring part, the bottom surface of which abuts the top end of the water supply pipe 14*b*. The top surface of the rubber part abuts the back side of the support part 23. Although the elastic member 31 is a rubber part in the present embodiment, the present invention is not limited to use a rubber part. The elastic member 31 may be, for example, a coil spring.

As shown in FIG. 4, since the slide bar 32, arranged in the width direction of each row of the adjoining water supply nozzles 12, slides in the width direction, the plurality of water supply nozzles 12 can be lifted up and down together. As shown in FIGS. 5 and 6(*a*), the slide bar 32 includes a bar section 32*a* extending above the engagement parts 24 of the adjoining water supply nozzles 12; and projection parts 32*b* formed on the bar section 32*a* and protruding downward. The projection parts 32*b* are disposed with predetermined intervals on the bar section 32*a*. The projection parts 32*b* are formed to protrude downward from the bottom surface of the bar section 32*a*. The interval of the projection parts 32*b* is equal to the interval of the adjoining water supply nozzles 12. In the present embodiment, the projection part 32*b* is formed in a trapezoidal shape when viewed in a cross section. In the present invention, the distance of the water supply nozzles 12 which will be lifted down by the bar section 32*a* can be appropriately set because the height of the projection part 32*b* (a distance from the bottom surface of the bar section 32*a* to the bottom end of the projection part 32*b*) is equal to the distance of the water supply nozzles 12 which will be lifted down by the bar section 32*a*.

As shown in FIGS. 5 and 6, the tab 33 prevents the slide bar 32 from being lifted up. The tab 33 is formed in a reversed L shape in the present embodiment. The tab 33 includes a vertical part 33*a* formed substantially vertically, and a protrusion 33*b* protruding horizontally from the top end of the vertical part 33*a*. The bottom end of the vertical part 33*a* is fixed on the top surface of the top base 13*a* of the coolant tank. In the present embodiment, the protrusion 33*b* is formed to have a bottom surface for always making contact with the top surface of the slide bar 32 in consideration of the water supply nozzles 12 urged upwardly by the elastic members 31. The tab 33 is formed in this fashion in the present embodiment, but may employ any other configurations as far as it can suppress any uplifting of the slide bar 32.

Hereafter, the casing Q will be explained in detail with reference to FIGS. 4 to 7. The casing Q encloses the cooling means 10 and the lift means 11 therein. An insertion hole 83, into which the slide bar 32 can be inserted, is formed in an external wall Qa of the casing Q. An O-ring 81 is provided in a space defined by the insertion hole 83, formed in the external wall Qa, and the slide bar 32. The O-ring 81 seals the interior of the casing Q reliably.

A feed screw 82 is provided on an end of the slide bar 32. The slide bar 32 can be slid horizontally within a predetermined range by turning the feed screw 82. The sliding distance obtained by turning the feed screw 82 is set to be substantially half a distance between the two adjoining water supply nozzles 12, 12 in the present embodiment. In the present embodiment, the feed screw 82 is connected to a control device, not shown in the accompanying drawings, and one slide bar 32 or plural slide bars 32 make sliding movement (reciprocal movement) in the width direction based on a signal supplied from the control device.

Hereafter an operation of the lift means 11 of the twin-belt casting machine 1 of the present embodiment will be explained.

As shown in FIG. 6, the lift means 11 lifts down the water supply nozzles 12 downward (i.e. toward inside the bottom endless belt 2*a*) by means of the sliding movement of the slide bar 32. That is, in a normal condition as shown in FIG. 6(*a*), the projection part 32*b* of the slide bar 32 is disposed between the two adjoining water supply nozzles 12, 12.

In order to lift down the water supply nozzles 12, the feed screw 82 is turned to slide the slide bar 32 in the horizontal direction (see FIG. 7). Accordingly, as shown in FIG. 6(*b*), the engagement part 24 is lifted down by the height of the projection part 32*b*, and the water supply nozzle 12 is also lifted down lower than the slide bar 32.

Conversely, in order to lift up the water supply nozzle 12 from the lifted down state, the feed screw 82 is turned to slide the slide bar 32 in the reverse horizontal direction. Accordingly, the water supply nozzle 12 is lifted up by the elastic member 31 higher than the slide bar 32 since the projection part 32*b* is arranged between the two adjoining water supply nozzles 12, 12. Note that the present embodiment enables lifting up and down of the water supply nozzle 12 smoothly because the projection part 32*b* has a trapezoidal shape as viewed in a cross section, and because two inclined sides of the trapezoid can slide on the engagement part 24.

Hereafter operations of lifting up and down the bottom endless belt 2*a* will be explained in detail with reference to FIG. 8.

In the present embodiment, the cooling temperature of the top cooling means 10 is set to be equal to the cooling temperature of the bottom cooling means 10. If the ingot S solidifies and contracts, the thickness of the ingot S decreases, and a space with a distance Kb is formed between the top surface of the ingot S and the top endless belt 2*b*. Therefore, according to the present embodiment, the bottom endless belt 2*a* alone may be lifted down within the separated part L. Note that the reduction rate of the thickness of the ingot S is about 1.5 to 2.0%.

In the present embodiment, the range of the separated part L, where the top surface of the ingot S becomes separated from the top endless belt 2*b* when the ingot S solidifies and contracts, is set from a start potion L1 where the thickness of the ingot S starts decreasing to an end L2 of the water supply nozzle 12 arranged on the downstream side.

The control device supplies a signal, which corresponds to the separated part L, to the feed screws 82 (see FIG. 7) disposed among the water supply nozzles 12 arranged inward of the bottom endless belt 2*a*, and then the corresponding slide bars 32 are slid in the width direction. Accordingly, the water supply nozzles 12 existing within the separated part L are lifted down by the distance Ka. That is, the bottom endless belt 2*a* is lifted down from the ingot S by the same distance as the distance of each water supply nozzle 12 lifted down and arranged inward of the bottom endless belt 2*a*.

According to the above-explained twin-belt casting machine 1, the distance Kb from the top surface of the ingot S to the top endless belt 2*b* can be set equal to the distance Ka from the bottom surface of the ingot S to the bottom endless belt 2*a*. Accordingly, it is possible to prevent uneven cooling of slabs between the top surface of the ingot S and the bottom surface thereof; therefore, strain of the slab S is suppressed, and the quality of the slab S can be improved.

Moreover, because strain can be prevented from being produced in the slab S, vibrations due to strain will no longer be transmitted to the meniscus part; therefore, preventing the formation of a surface defect. Furthermore, a skin-pass rolling mill, and a winding device and the like arranged at the downstream side of the twin-belt casting machine 1 can be operated properly.

Because the plurality of water supply nozzles 12 arranged in the width direction can be lifted up and down together by using the slide bar 32, the plurality of water supply nozzles 12 existing within the separated part L can be lifted down precisely together. This mechanism improves the efficiency in the lifting-up and lifting-down operations. Moreover, since the slide bars 32 can be slid appropriately in accordance with the separated part L, the length of cavity can be changed effectively.

<Fourth Embodiment>

Hereafter a fourth embodiment, in which the top endless belt is lifted up and down, will be explained in detail with reference to FIG. 9. FIG. 9 is a side view showing the endless belts separated from each other at the downstream side of the cavity according to the fourth embodiment.

In the third embodiment, the cooling temperature of the top cooling means 10 is set substantially equal to the cooling temperature of the bottom cooling means 10, but the fourth embodiment differs from the third embodiment in that the cooling temperature of the top cooling means 10 is lowered. In this case, as shown in FIG. 2, a space with the distance Ka is formed between the bottom surface of the ingot S and the bottom endless belt 2*a*.

Therefore, in the fourth embodiment, the top endless belt 2*b* alone may be lifted up (i.e. moved toward inside the top endless belt 2*b*) within the separated part L. In the present embodiment, when the plurality of water supply nozzles 12 arranged inward of the top endless belt 2*b* are lifted up, the top endless belt 2*b* is also lifted up by the distance equal to that of the lifted-up water supply nozzles 12. Since the lifting mechanism of the top endless belt 2*b* is the same as that of the bottom endless belt 2*a*, duplicated explanations will be omitted in the present embodiment.

The lift means 11 according to the third and fourth embodiments comprises: the elastic member 31 arranged inside the water supply nozzle 12; and the slide bar 32 etc., but the present invention is not limited to this configuration, and can employ other configurations. Modified examples of the lift means will be explained below.

First Modified Example

Figures 10A, 10B:
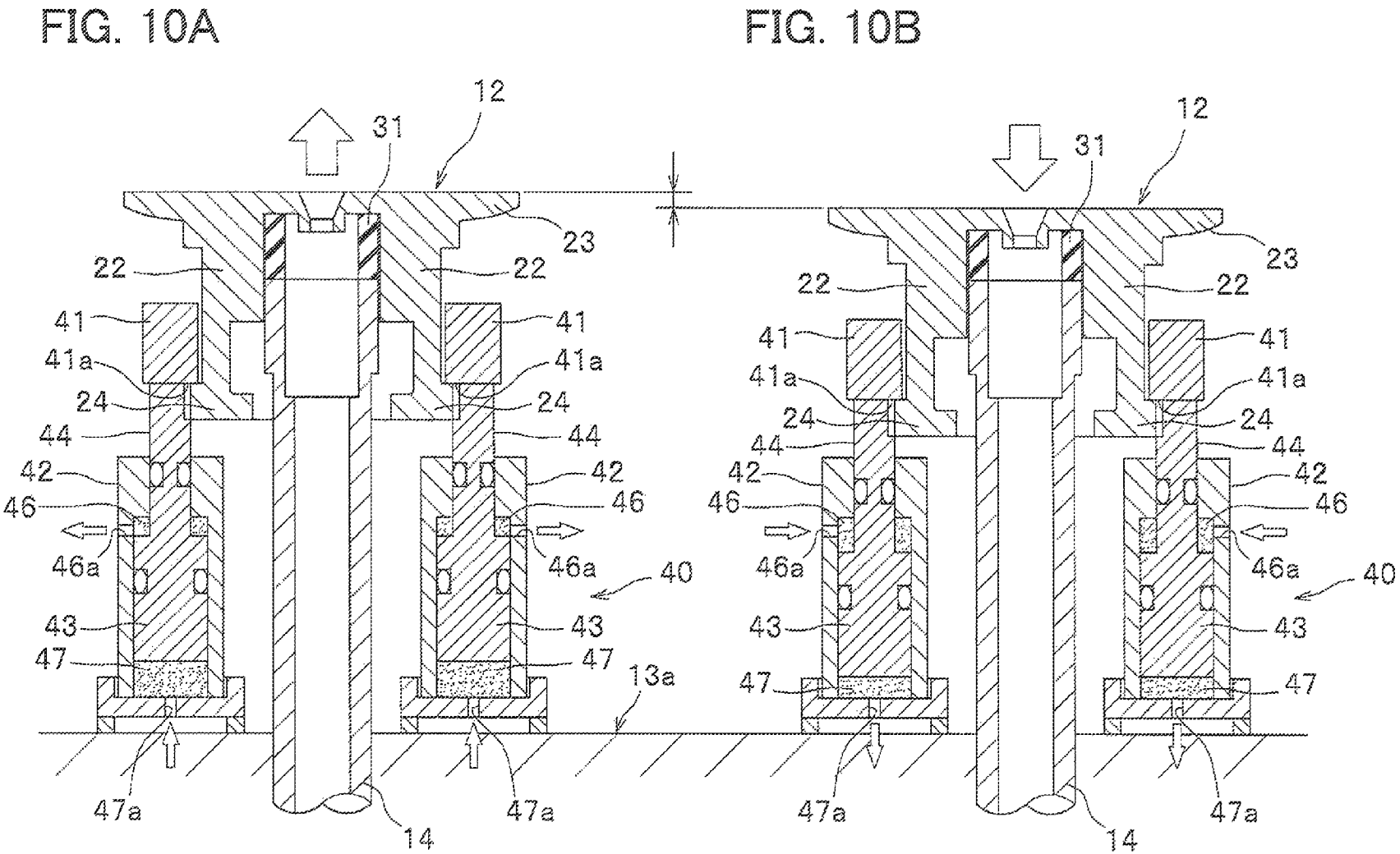
FIG. 10 is a side cross-sectional view showing a first modified example of the lift means, where (a) shows a lifted-up condition of a nozzle and (b) shows a lifted-down condition of the nozzle.
Figure 11:
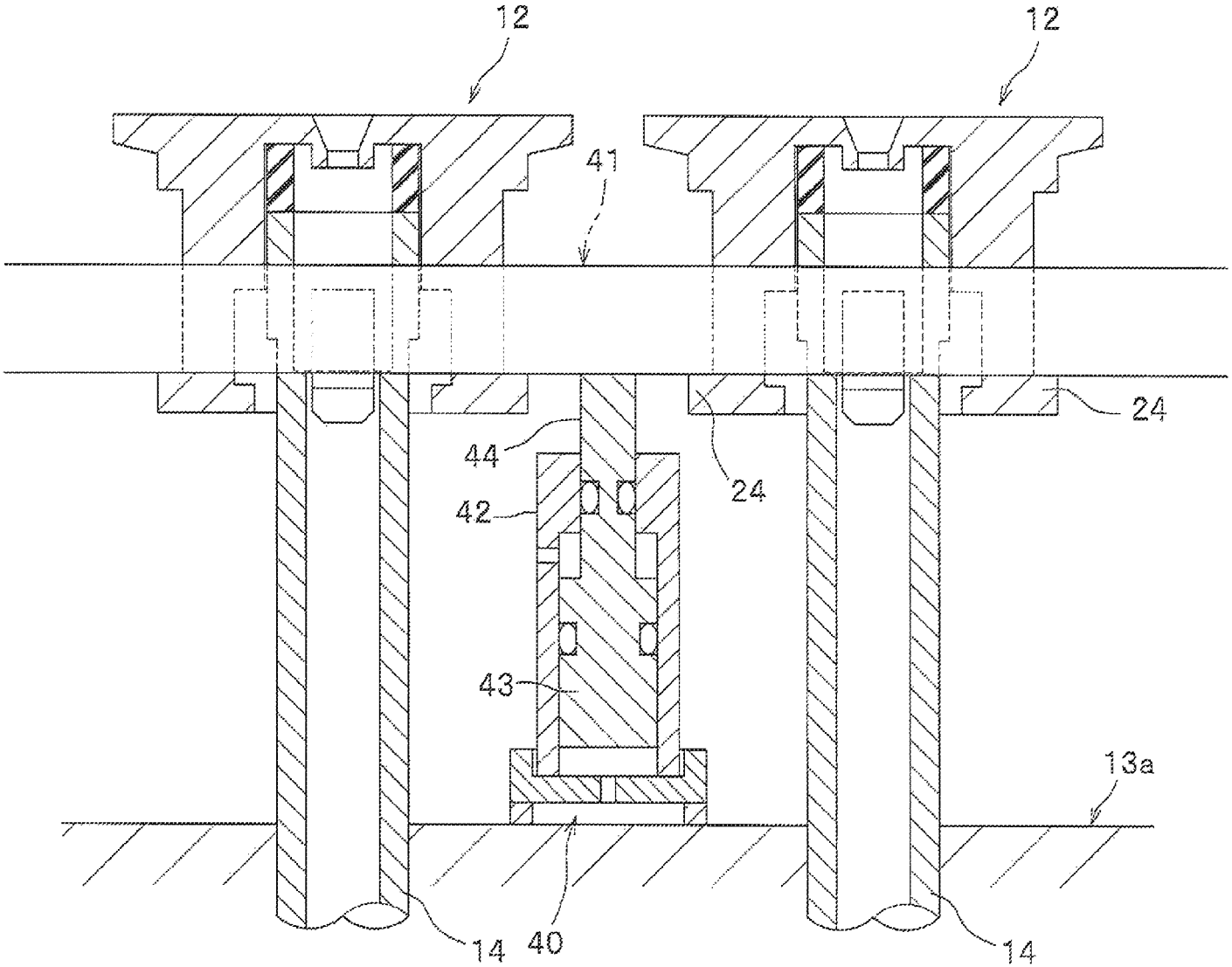
FIG. 11 is a front view showing the first modified example of the lift means.

FIG. 10 is a side cross-sectional view showing a first modified example of the lift means, where (a) shows a lifted-up condition of a nozzle and (b) shows a lifted-down condition of the nozzle. FIG. 11 is a front view showing the first modified example of the lift means.

Lift means 40 of the first modified example is characterized in including a piston mechanism. That is, the lift means 40 includes: a connecting bar 41 attached to the plurality of adjoining water supply nozzles 12; a cylinder 42 provided beneath the connecting bar 41; a piston 43 sliding inside the cylinder 42; and a piston rod 44 connecting the piston 43 to the connecting bar 41. The lift means 40 is mounted on the top surface of an top base 13*a* of the coolant tank, and has a space below the bottom face of the cylinder 42.

As shown in FIGS. 10 and 11, the connecting bar 41 is a bar member attached to the plurality of water supply nozzles 12, 12, . . . , and adjoining in the width direction of the twin-belt casting machine 1. The connecting bar 41 has a rectangular cross section. The connecting bar 41 lifts up and down each row of the plurality of nozzles 12 together by means of the piston mechanism. The bottom surface of the connecting bar 41 is making contact with the top end of the piston rod 44. A corner section 41*a* of the bottom surface of the connecting bar 41 projects from the piston rod 44 in the width direction and engages with the engagement part 24 of the water supply nozzle 12.

Similarly to the third embodiment, the water supply nozzle 12 covers the top part of the water supply pipe 14 and is slidable in the vertical direction. The elastic member 31 is disposed in the water supply nozzle 12. The elastic member 31 is a rubber-made ring part. The elastic member 31 has the bottom end abutting the water supply pipe 14, and also has the top end abutting the back side of the support part 23 of the water supply nozzle 12. The elastic member 31 urges the water supply nozzle 12 upward relative to the water supply pipe 14.

The cylinder 42 has a substantial cylindrical shape, and allows the piston 43 to slide on the interior thereof. The volume of the piston 43 is smaller than the capacity of the cylinder 42. A first compression cavity 46 is formed above the top part of the piston 43 in the cylinder 42, and a second compression cavity 47 is formed below the bottom part of the piston 43 in the cylinder 42. A hole 46*a* communicating with the first compression cavity 46 is formed in the side wall of the cylinder 42, and a hole 47*a* communicating with the second compression cavity 47 is formed through the bottom of the cylinder 42.

The piston 43 and the piston rod 44 can be lifted up by pressurizing the second compression cavity 47 and decompressing the first compression cavity 46 by means of the lift means 40. Conversely, the piston 43 and the piston rod 44 can be lifted down by decompressing the second compression cavity 47 and pressurizing the first compression cavity 46 by means of the lift means 40. That is, in order to lift down the water supply nozzle 12, the first compression cavity 46 is pressurized and the second compression cavity 47 is decompressed, and then, the water supply nozzle 12 is lifted down as shown in FIG. 10(*b*). The engagement part 24 of the water supply nozzle 12 is lifted down by the connection bar 41; therefore, the water supply nozzle 12 can be lifted down.

Conversely, in order to lift up the water supply nozzle 12, the second compression cavity 47 is pressurized and the first compression cavity 46 is decompressed, and then, the piston 43 and the piston rod 44 are lifted up. The water supply nozzle 12 is lifted up (toward the slab) by means of the urging force applied by the elastic member 31 arranged inside the water supply nozzle 12.

Note that the pressure can be applied into the first compression cavity 46 and the second compression cavity 47 by means of pneumatic or hydraulic equipment using air, water, or oil, which is not limited to any particular kind. It is preferable that the lift means 40 should be connected to a controller, not shown in the accompanying drawings, and the connecting bars 41 should be lifted up and down appropriately in accordance with the separated part L (see FIG. 8).

Second Modified Example

Figures 12A, 12B:
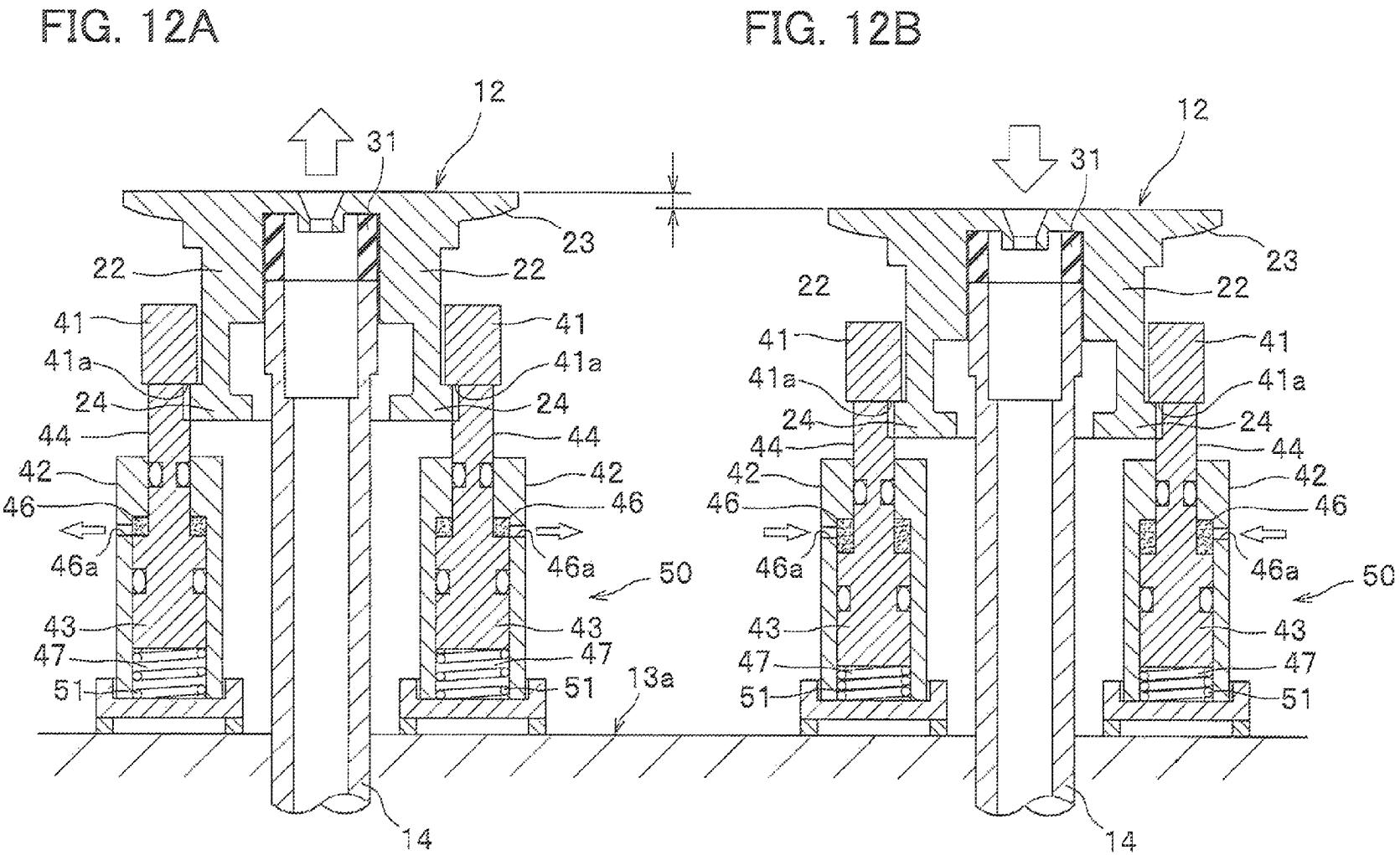
FIG. 12 is a side cross-sectional view showing a second modified example of the lift means, where (a) is in a nozzle ascended condition and (b) is a nozzle descended condition.

FIG. 12 is a side cross-sectional view showing a second modified example of the lift means, where (a) shows a nozzle in a lifted-up condition and (b) shows a nozzle in a lifted-down condition. A lift means 50 of the second modified example differs from the first modified example in that resilient member 51 is provided in the second compression cavity 47. The resilient member 51 is, for example, a coil spring. The resilient member 51 has a top end making contact with the bottom surface of the piston 43, and has the bottom end making contact with the bottom face of the cylinder 42. The resilient member 51 urges the piston 43 upward. The resilient member 51 is a coil spring in the present embodiment, but may be any other resilient members. The lift means 50 is the same as that of the first modified example except the resilient member 51, and the duplicated explanation thereof will be omitted.

According to the lift means 50, when the water supply nozzle 12 is lifted down, as shown in FIG. 12(*b*), pressure is applied into the first compression cavity 46 to lift down the piston 43 and the piston rod 44. Accordingly, the water supply nozzle 12 can be lifted down. Conversely, when the water supply nozzle 12 is ascended, as shown in FIG. 12(*a*), pressure is relieved from the first compression cavity 46, the piston 43 and the piston rod 44 are ascended by urging force of the resilient member 51, and the water supply nozzle 12 is also ascended by urging force of the elastic member 31.

Third Modified Example

Figure 13B:
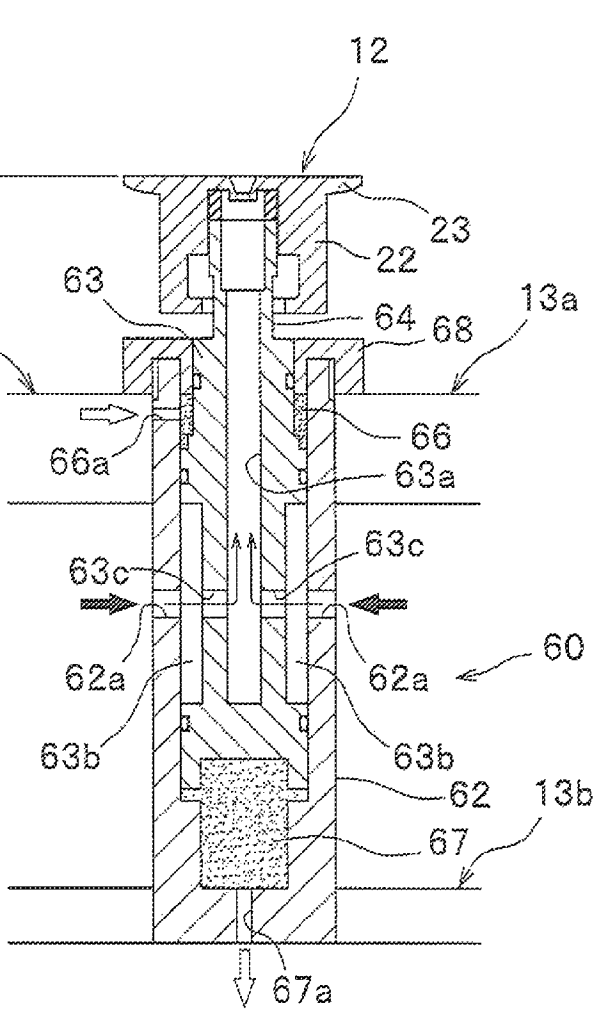
FIG. 13 is a side cross-sectional view showing a third modified example of the lift means, where (a) shows the nozzle in a lifted-up condition and (b) shows the nozzle in the lifted-down condition.
Figure 13A:
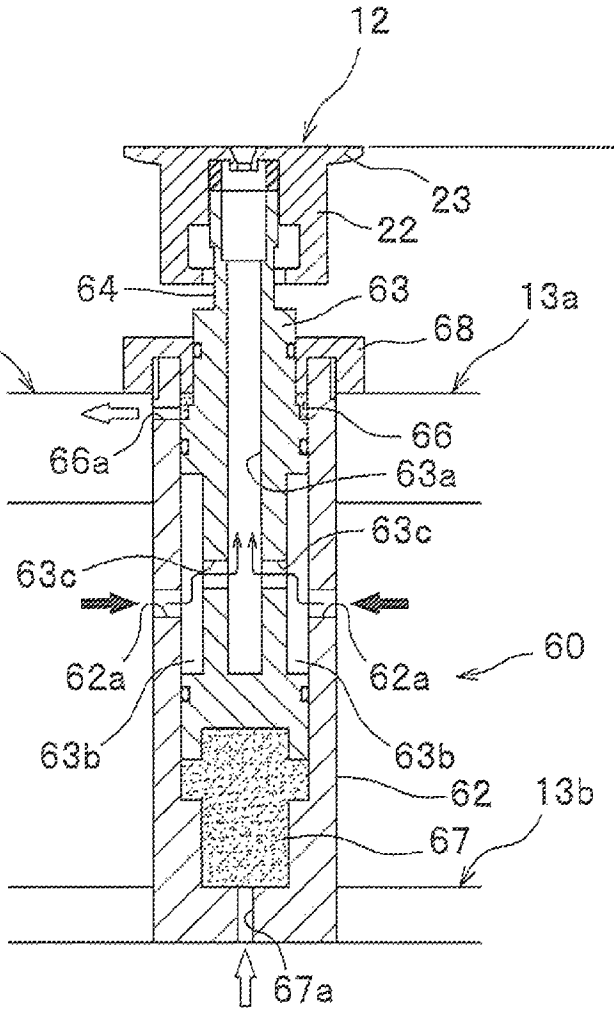

FIG. 13 is a side cross-sectional view showing a third modified example of the lift means, where (a) shows a nozzle in a lifted-up condition and (b) shows a nozzle in a lifted down condition. A lift means 60 of the third modified example has the piston mechanism inside the coolant tank 13, and supplies the coolant water through a piston rod 64.

The lift means 60 has: a cylinder 62 provided beneath the water supply nozzle 12 inside the coolant tank 13; a piston 63 which slides inside the cylinder 62; and a piston rod 64 which supplies the coolant water to the water supply nozzle 12 and connects the piston 63 to the water supply nozzle 12.

The cylinder 62 has a cylindrical shape, and extends from a bottom base 13*b* of the coolant tank 13 to the top base 13*a*. The cylinder 62 allows the piston 63 to slide on the interior thereof in the vertical direction. A hole 66*a*, formed in the side wall of the cylinder 62, communicates with a first compression cavity 66. A second hole 67*a*, formed in the bottom face of the cylinder 62, communicates with the second compression cavity 67. The coolant water stored in the coolant tank 13 is introduced into a hollow part 63*a* through a hole 62*a* which is formed in the middle part of the cylinder 62. The top end part of the cylinder 62 is sealed by a cap 68.

The piston 63 is formed to have a volume smaller than the capacity of the cylinder 62. The first compression cavity 66 is formed between the top part of the piston 63 and the cylinder 62, and the second compression cavity 67 is formed between the bottom part of the piston 63 and the cylinder 62.

The hollow part 63*a* extending in the vertical direction is formed in the piston 63. The coolant water stored in the coolant tank 13 is introduced into the hollow part 63*a* through a first communicating part 63*b* and a second communicating part 63*c*, both of which are formed in the vicinity of the bottom part of the hollow part 63*a*. The first communicating part 63*b* is an annular space formed between the inner circumference of the cylinder 62 and the outer circumference of the piston 63. The first communicating part 63*b* extends in the vertical direction along the inner circumference of the cylinder 62. A part of the first communicating part 63*b* communicates with the hole 62*a* continually even if the piston 63 slides in the vertical direction. The second communicating unit 63*c* is a space connecting the hollow part 63*a* to the first communicating part 63*b*.

The piston rod 64 connects the piston 63 to the water supply nozzle 12, and introduces the coolant water flowing into the first communicating part 63*b* and the second communicating part 63*c* to the water supply nozzle 12. The piston rod 64 has the hollow part 63*a* which extends from the piston 63 inside the piston rod 64. This structure allows the coolant water to be introduced to the water supply nozzle 12.

The lift means 60 having the aforementioned piston mechanism allows the piston 63, the piston rod 64, and the water supply nozzle 12 to be lifted up (or down) by pressurizing the second compression cavity 67 and decompressing the first compression cavity 66 (or by decompressing the second compression cavity 67 and pressurizing the first compression cavity 66). As shown in FIG. 13(*a*) and (b), even if the piston rod 64 is lifted up or down, it is possible to supply the coolant water to the water supply nozzle 12 through the piston 63 and the piston rod 64 because the lift means 60 has the hole 62*a*, the first communicating part 63*b*, the second communicating part 63*c*, and the hollow part 63*a*, all of which communicate with one another continually. As explained above, since the third modified example provides the lift means 60, which can supply the coolant water through the piston 63 and the piston rod 64 with a simple mechanism, the number of parts can be reduced.

The present invention is not limited to the third modified example configured as explained above. For example, in order to supply the coolant water from the coolant tank 13 to the piston rod 64, at least the hole 62*a* formed in the cylinder 62 may communicate with the piston rod 64.

Fourth Modified Example

Figure 14B:
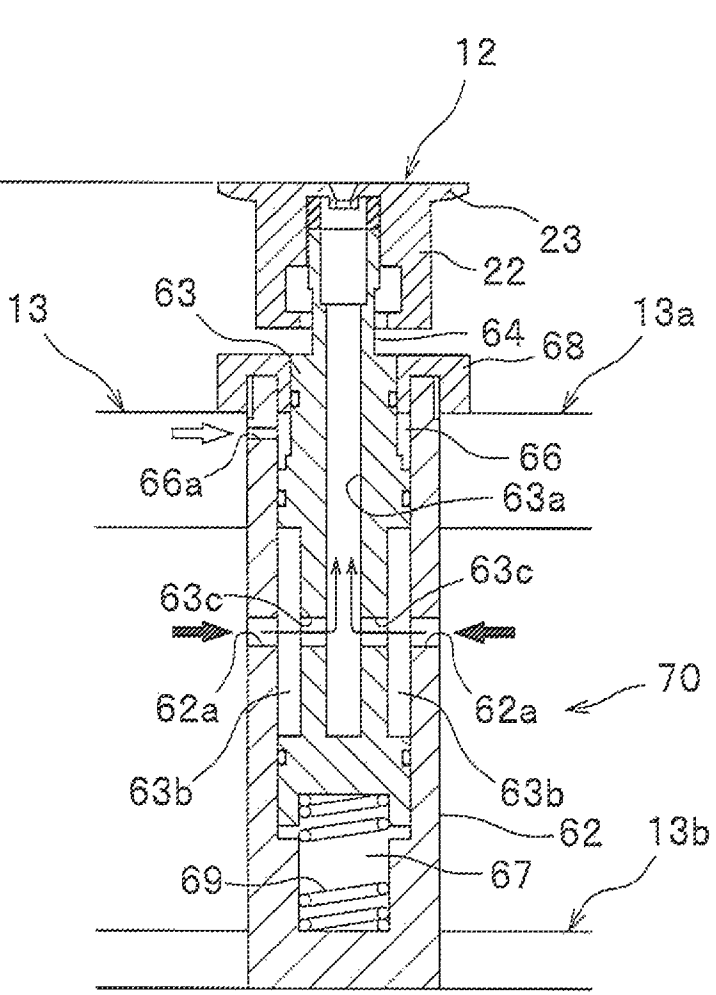
FIG. 14 is a side cross-sectional view showing a fourth modified example of the lift means, where (a) shows the nozzle in the lifted-up condition and (b) shows the nozzle in the lifted-down condition.
Figure 14A:
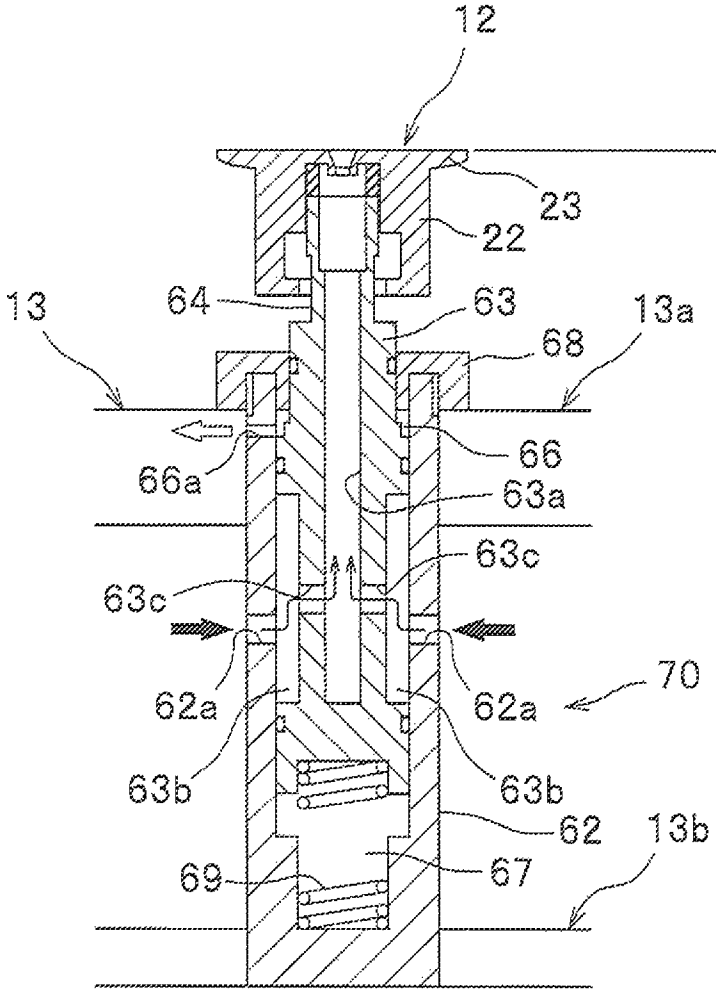

FIG. 14 is a side cross-sectional view showing a fourth modified example of the lift means, where (a) shows a nozzle in a lifted-up condition and (b) shows a nozzle in a lifted-down condition. A lift means 70 of the fourth modified example differs from the third modified example in that a resilient member 69 is disposed in the second compression cavity 67. The resilient member 69 is, for example, a coil spring. The resilient member 69 has a top end making contact with the bottom surface of the piston 63, and has a bottom end making contact with the bottom face of the cylinder 62. The resilient member 69 urges the piston 63 upward. Although the resilient member 69 is a coil spring in the present embodiment, other resilient members may be used. The lift means 70 is the same as that of the third modified example except for the configuration of the resilient member 69, and the duplicated explanation will be omitted.

In order to lift down the water supply nozzle 12 as shown in FIG. 14(*b*), the lift means 70pressureizes the first compression cavity 66 to lift down the piston 63 and the piston rod 64. The water supply nozzle 12 is lifted down in this manner. Conversely, in order to lift up the water supply nozzle 12 as shown in FIG. 14(*a*), the lift means 70 decompresses the first compression cavity 66. The piston 63 and the piston rod 64 are lifted up by means of the urging force given by the resilient member 69. The water supply nozzle 12 is lifted up in this manner.

According to the above-explained first to fourth modified examples, the water supply nozzle 12 can be lifted up and down by means of pressure. Therefore, it is possible to make the endless belt 2 to approach the ingot S or to become separated from the ingot S. In one example which we consider with reference to FIG. 2(*a*), the bottom surface of the ingot S and the bottom endless belt 2*a* are separated initially. Then, the bottom endless belt 2*a* is lifted up above a height position where the ingot S makes contact with the bottom endless belt 2*a* on the upstream side to make the bottom surface of the ingot S contact the bottom endless belt 2*a*. This prevents an uneven cooling condition between the top surface and the bottom surface of a slab even if the endless belt 2 is moved closer to the ingot S.

<Fifth Embodiment>

Figure 15:
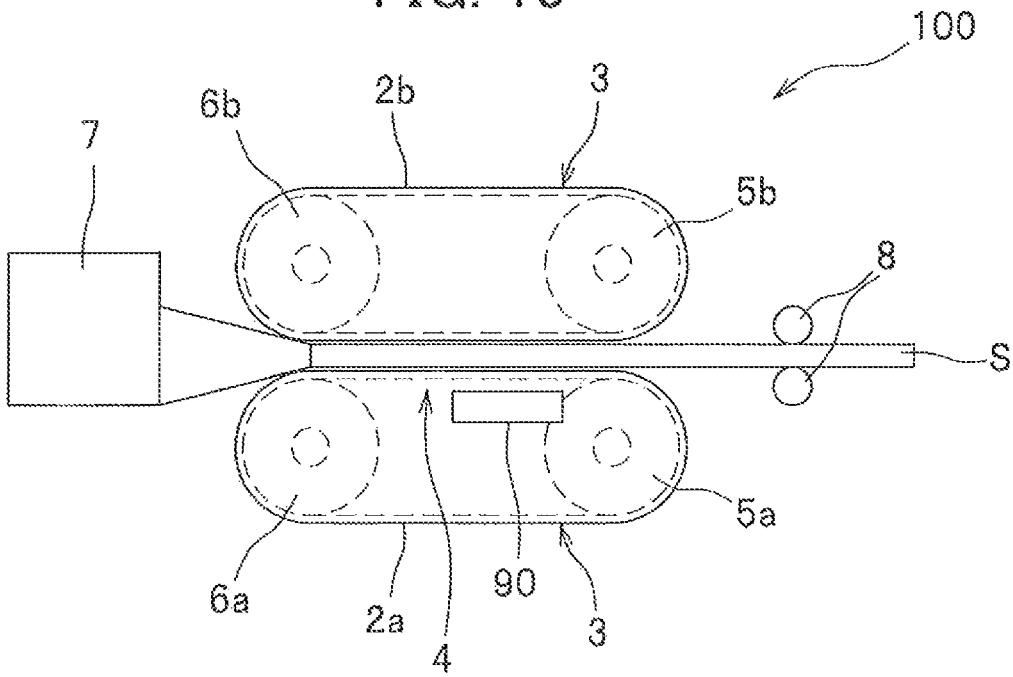
FIG. 15 is a side view showing a twin-belt casting machine according to a fifth embodiment.
Figure 16:
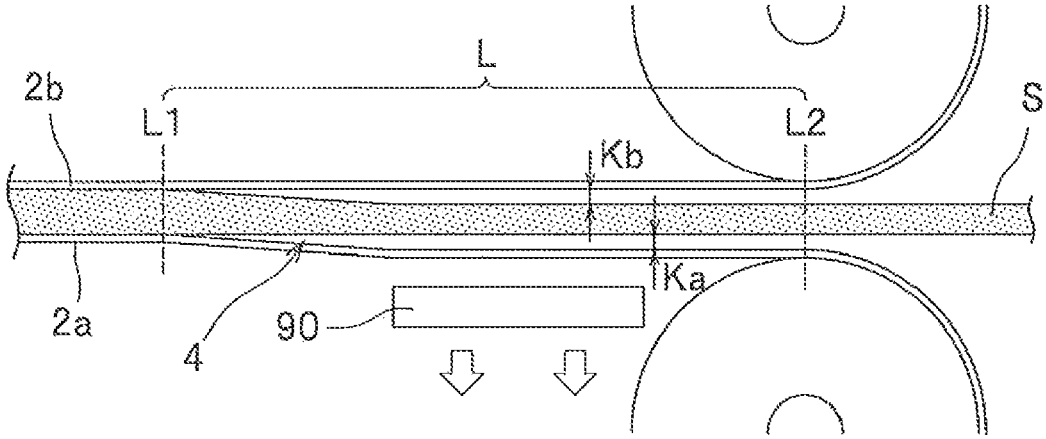
FIG. 16 is an enlarged view showing a downstream side of a cavity according to the fifth embodiment.

Hereafter a fifth embodiment of the present invention will be explained with reference to FIGS. 15 and 16, in which an electromagnetic force is used for adjusting the distance between a slab and a rotating belt.

In the third and fourth embodiments, the bottom endless belt 2*a* and the top endless belt 2*b* are lifted up and down by using the lift means 11 as the distance adjusting means. In contrast, the fifth embodiment utilizes an electromagnetic force.

The twin-belt casting machine 1 of the fifth embodiment includes an electrical magnet 90 as the distance adjusting means disposed inside the bottom rotating belt unit 3. The electrical magnet 90 is a conventionally known electrical magnet, and is disposed to face the back surface of the bottom endless belt 2*a* on the downstream side of the cavity 4. Because the bottom endless belt 2*a* comprises thin metal plates, as shown in FIG. 16, when the electrical magnet 90 is lifted down, the bottom endless belt 2*a* is also lifted down. This prevents an uneven cooling condition between the top surface and the bottom surface of a slab. Note that it is preferable that the distance Ka between the bottom surface of the ingot S and the bottom endless belt 2*a* should be substantially equal to the distance Kb between the top surface of the ingot S and the top endless belt 2*b*.

According to the fifth embodiment, the electrical magnet 90 is arranged only inside the bottom rotating belt unit 3, but the electrical magnet 90 may be arranged inside the top rotating belt unit 3. The shape, the size and the like of the electrical magnet 90 can be designed in accordance with the length etc. of the cavity 4.

The present invention is not limited to the above-explained embodiments, and can be changed and modified within the scope and the spirit of the present invention.

For example, in the foregoing embodiments, a liquid (water) is used as a coolant medium used for the cooling means. But in the present invention, other kinds of liquid, e.g. gas or the like may be used. Moreover, the feed screw used for sliding the slide bar may be replaced by other mechanisms as long as they can move the water supply nozzle in the lateral direction.

In the foregoing embodiments, uneven cooling condition between the top surface and the bottom surface of a slab is prevented by adjusting the distance between the endless belt and the ingot, but the present invention is not limited to this principle, and non-illustrated temperature adjusting means equipped in the cooling means may be used. For example with reference to FIG. 2(*a*), the cooling medium of the cooling means arranged on the top side may be set to have a higher temperature than that of the cooling medium of the cooling means arranged at the bottom side, because this configuration can also prevent uneven cooling condition between the top surface and the bottom surface of a slab.

Needless to say, both temperature adjusting means and distance adjusting means can be used together to prevent uneven cooling condition between the top surface and the bottom surface of a slab.

In the foregoing embodiments, since as the plurality of water supply nozzles disposed in the width direction of the slab are lifted up and down together as a row, uneven cooling condition between the top surface and the bottom surface of a slab can be prevented in view of a change in the thickness of the slab with respect to the casting direction of the slab (see FIG. 8).

However, the present invention is not limited to this configuration, and some of the plurality of water supply nozzles disposed in the width direction of the slab may be lifted up and down relative to other water supply nozzles. According to this configuration, in the width direction of the slab, even if the distance between the bottom endless belt and the bottom surface of the slab is different from the distance between the top endless belt and the top surface of the slab, the distance between the bottom endless belt and the bottom surface of the slab and the distance between the top endless belt and the top surface of the slab can be adjusted.

For example, in contrast to the plurality of projection parts 32*b*, 32*b*, . . . , formed on the slide bar 32 in the third embodiment and maintaining the same height as shown FIG. 6, heights may be different among the plurality of projection parts 32*b*. This configuration enables some projection parts 32*b*, 32*b* to have heights varied in the width direction of the slab. That is, by employing such a configuration, it becomes possible to cope with not only uneven cooling condition between the top surface and the bottom surface of a slab due to solidification and shrinkage of the slab relative to the casting direction, but also with uneven cooling condition between the top surface and the bottom surface of a slab due to solidification and shrinkage of the slab relative to the width direction of the slab.

In the third and fourth modified examples shown in FIGS. 13 and 14, the same effect can be achieved if some lift means 60, 70 arranged in the width direction of the slab are operated.

The invention claimed is:

1. A twin-belt casting machine for casting continuously a slab from a molten metal, comprising:

a pair of rotating belt units arranged vertically and disposed opposite each other, each rotating belt unit including an endless belt;

a cavity formed between the pair of rotating belt units, the cavity into which the molten metal is supplied;

a cooling component arranged inside each rotating belt unit, wherein the cooling component is disposed in a casing and includes a plurality of nozzles, each of the plurality of nozzles including a support part having an aperture defined therein orientated toward an associated endless belt, and wherein a coolant flowing through the aperture supports the associated endless belt; and a distance adjustment component including a lift component that actuates the plurality of nozzles up and down, disposed inside at least one of the pair of rotating belt units, for lifting up and down the endless belt relative to the slab in accordance with a part where the slab and the endless belt become separated from each other.

2. The twin-belt casting machine according to claim 1, wherein the lift component includes:

a cylinder provided at one end of the nozzle;

a piston sliding inside the cylinder; and a piston rod connecting the piston and the nozzle, and wherein the nozzle is lifted a up and down by means of pressure.

3. The twin-belt casting machine according to claim 2, wherein the piston rod has a hollow part formed in the piston rod, and the hollow part supplies the cooling medium to the nozzle.

4. The twin-belt casting machine according to claim 1, wherein the lift component includes:

a connecting bar attached to the plurality of nozzles;

a cylinder provided in a vicinity of the connecting bar;

a piston sliding inside the cylinder; and a piston rod connecting the piston and the connecting bar together, and wherein the nozzle is lifted up and down by means of pressure.

5. The twin-belt casting machine according to claim 1, wherein the lift component includes:

an elastic member disposed inside each nozzle of the plurality of nozzles that biases each nozzle toward an associated endless belt side;

a slide bar disposed in the vicinity of the plurality of nozzles; and an engagement part formed on each nozzle of the plurality of nozzles, wherein projection parts protruding from the slide bar and arranged in a lengthwise direction of the slide bar at a predetermined interval engage with the engagement parts corresponding to respective projection parts when the slide bar moves in a lateral direction relative to the nozzle, thereby lifting down the nozzle.

6. The twin-belt casting machine according to claim 5, wherein the slide bar is actuated by a feed screw.

7. The twin-belt casting machine according to claim 5, wherein an insertion hole into which the slide bar is inserted is formed in an external wall of the casing, and an O-ring is provided at a clearance formed between the insertion hole and the slide bar.

8. The twin-belt casting machine according to claim 1, wherein the distance adjustment component is configured and arranged to adjust a distance between the endless belt and slab by electromagnetic force.

9. The twin-belt casting machine according to claim 1, wherein the distance adjustment component is configured and arranged to actuate a part of the endless belt towards and away from the slab in a width direction of the slab.

* * * * *